US006981780B2

(12) United States Patent
Einav

(10) Patent No.: US 6,981,780 B2
(45) Date of Patent: Jan. 3, 2006

(54) TOOL BOX WITH LIGHT

(75) Inventor: Yehuda Einav, Nes-Tziona (IL)

(73) Assignee: Zag Industries Ltd., Rosh Ha'Ayin (IL)

( * ) Notice: Subject to any disclaimer, the term of this patent is extended or adjusted under 35 U.S.C. 154(b) by 0 days.

(21) Appl. No.: 10/715,439

(22) Filed: Nov. 19, 2003

(65) Prior Publication Data

US 2004/0125597 A1 Jul. 1, 2004

Related U.S. Application Data

(60) Provisional application No. 60/437,063, filed on Dec. 31, 2002.

(51) Int. Cl.
*F21V 33/00* (2006.01)

(52) U.S. Cl. ..... 362/154; 362/190

(58) Field of Classification Search ..... 362/154, 362/156, 190, 191; 206/216, 234, 372
See application file for complete search history.

(56) References Cited

U.S. PATENT DOCUMENTS

| | | | | |
|---|---|---|---|---|
| 3,938,132 A | | 2/1976 | Cunningham | 43/17.5 |
| 4,855,881 A | | 8/1989 | Pence | 362/156 |
| 5,011,013 A | * | 4/1991 | Meisner et al. | 206/373 |
| 5,299,722 A | | 4/1994 | Cheney | 43/57.1 |
| D352,393 S | | 11/1994 | Fiore | D3/260 |
| 5,459,648 A | | 10/1995 | Courtney | 362/154 |
| 5,611,170 A | | 3/1997 | McGuff et al. | 43/57.1 |
| 5,624,029 A | | 4/1997 | Shih | 206/372 |
| 5,685,421 A | | 11/1997 | Gilmore | 206/216 |
| 5,727,835 A | | 3/1998 | Krush et al. | 296/37.6 |
| 5,826,718 A | | 10/1998 | Ahern, Jr. et al. | 206/372 |
| 5,833,352 A | | 11/1998 | Goodwin | 862/156 |
| 5,913,380 A | * | 6/1999 | Gugel et al. | 182/129 |
| 6,237,767 B1 | | 5/2001 | Lee | 206/373 |
| 6,254,251 B1 | | 7/2001 | Washington | 362/154 |
| 6,267,240 B1 | | 7/2001 | Callaway | 206/373 |
| 6,267,484 B1 | | 7/2001 | Baker et al. | 362/156 |
| 6,405,858 B1 | | 6/2002 | Gagliardi | 206/6.1 |

* cited by examiner

*Primary Examiner*—Sandra O'Shea
*Assistant Examiner*—Mark Tsidulko
(74) *Attorney, Agent, or Firm*—Pillsbury Winthrop Shaw Pittman LLP

(57) ABSTRACT

A container, such as a tool box, has an interior storage compartment and a cover with a light opening therein. A light is mounted within the compartment and is selectively positionable to shine through the light opening or to illuminate the interior of the storage compartment. Preferably, the light is mounted on an articulated hinge allowing movement between a plurality of discrete positions and locks in place in a stored position. The light may be battery operated and may be removable if desired.

23 Claims, 6 Drawing Sheets

TOOL BOX WITH LIGHT

RELATED APPLICATIONS

This application claims priority to U.S. Provisional application Ser. No. 60/437,063 filed Dec. 31, 2002. The entirety of the provisional application is incorporated herein by reference.

BACKGROUND OF THE INVENTION

1. Field of the Invention

The invention is directed to a tool box. In particular, this invention is directed to a tool box with a light.

2. Discussion of Related Art

Typically, tool boxes are used to store tools or other items for portability. A user can transport the items to any desired location. As a result, the chosen location may or may not have adequate lighting to use the stored items. Areas under repair or construction often have inadequate lighting.

Poor lighting can pose several problems for the user. First, it may be difficult to locate items stored in the box. This is especially dangerous when the items are sharp. Second, it is difficult to properly use the items when the surrounding area is dark or not sufficiently illuminated.

For example, an automobile driver can experience a flat tire anywhere, which includes dark or poorly light roadways. On a dark roadway, it would be difficult to find the necessary tools in the box without the aid of a light. Even with a hand held flashlight, it would be difficult to use the tools while holding the flashlight. In such a situation, a conventional tool box may be rendered useless.

Thus, there is a need for a container, such as a tool box, that has a self contained light, especially a light that can be used when the tool box is open or closed.

SUMMARY OF THE INVENTION

An aspect of this invention is to provide a container with a self contained illumination device.

Another aspect of this invention is to provide a container with a light that can be used when the container is open and closed.

A further aspect of the invention is to provide a container that has an interior storage compartment suitable for storing tools and has an integral light.

An additional aspect of the invention is to provide a tool box with a light that can be positioned to illuminate surrounding areas and the interior of the tool box.

The invention relates to a tool box comprising a base having a bottom and side walls, and a cover having a top and side walls. The cover is movably mounted to the base to move between a closed position and an open position, and the base and the cover define a storage compartment therein. One of the side walls has a light permeable lens mounted therein. A light is mounted in the storage compartment and includes a power source and an illumination device. The illumination device is oriented toward the light permeable lens.

The light can be movably mounted in the cover on an articulated support such that the light is movable between a first position directed to the light permeable lens and a second position directed within the base. The box may have a pivoting handle mounted to the cover and a removable tray disposed within the box.

The invention also relates to a container comprising a bottom wall, a top wall, and an outer side wall extending between the bottom wall and the top wall to form a fully contained interior storage compartment. The outer side wall has a light transmitting opening therethrough. A light is mounted within the interior storage compartment and includes a power source and an illumination device. The illumination device is positioned at the light transmitting opening.

The container may have an articulated support coupled to the light such that the light may be moved from a first position directed at the light transmitting opening to a second position directed within the interior storage compartment.

These and other aspects of the invention will be apparent taken with the detailed description below.

DETAILED DESCRIPTION OF THE DRAWINGS

Features of the invention are shown in the drawings in which.

DETAILED DESCRIPTION OF PREFERRED EMBODIMENTS

This invention relates to a container and is described with particular reference to a container used as a tool box 10. However, it should be understood that the invention can be applied to any storage container, not necessarily intended to store tools. For example, the container could be used for make-up, art supplies, gardening tools, or any desired items. Thus, the reference to a tool box used herein is intended to generically cover any portable storage container.

Figure 1:
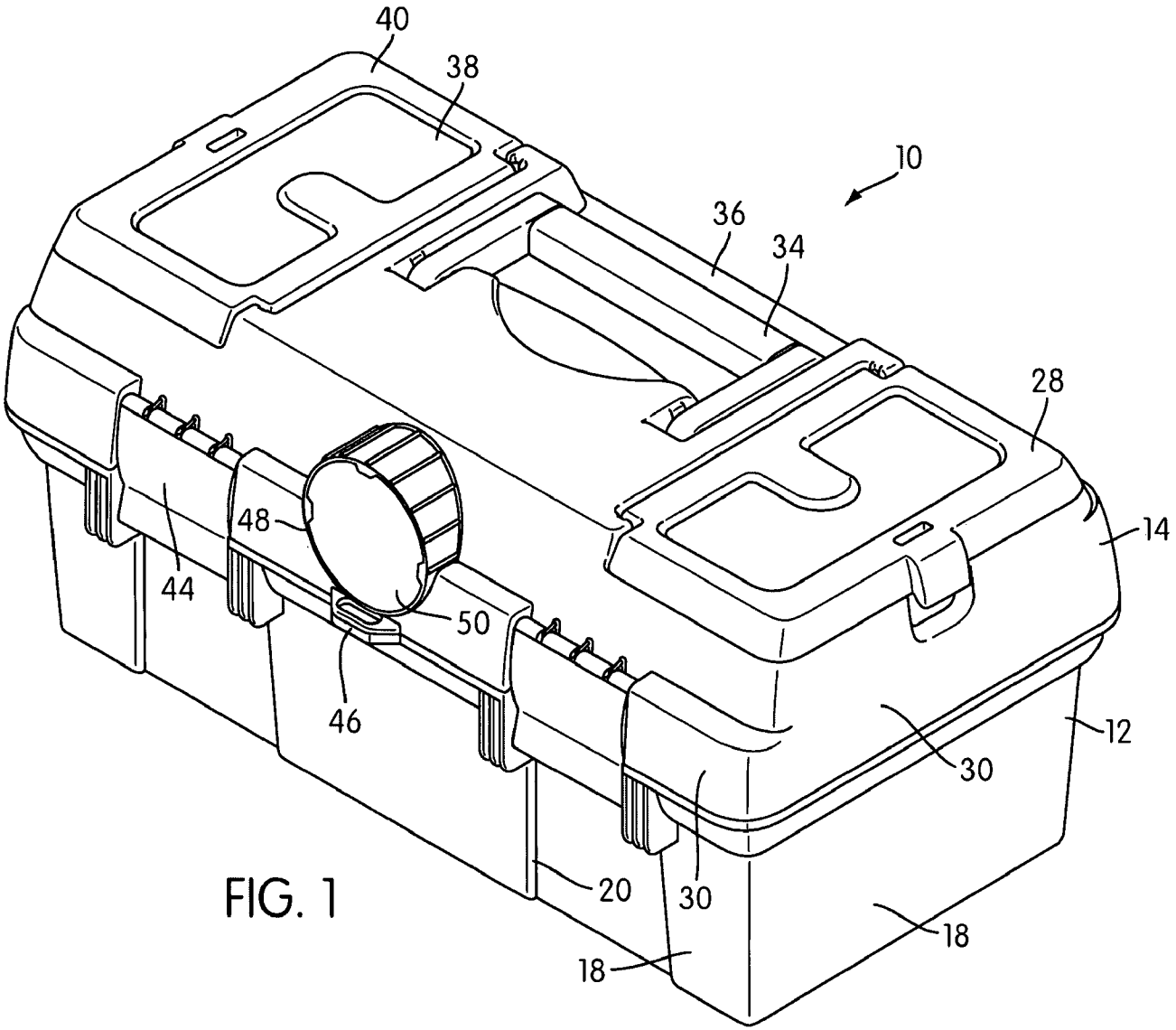
FIG. 1 is perspective front view of the container in accordance with a preferred embodiment of the invention in a closed position.

Referring to FIG. 1, tool box 10 includes a base 12 and a cover 14, both preferably made of molded plastic. Of course, other materials could be used, including metal, wood, or composites.

Figure 2:
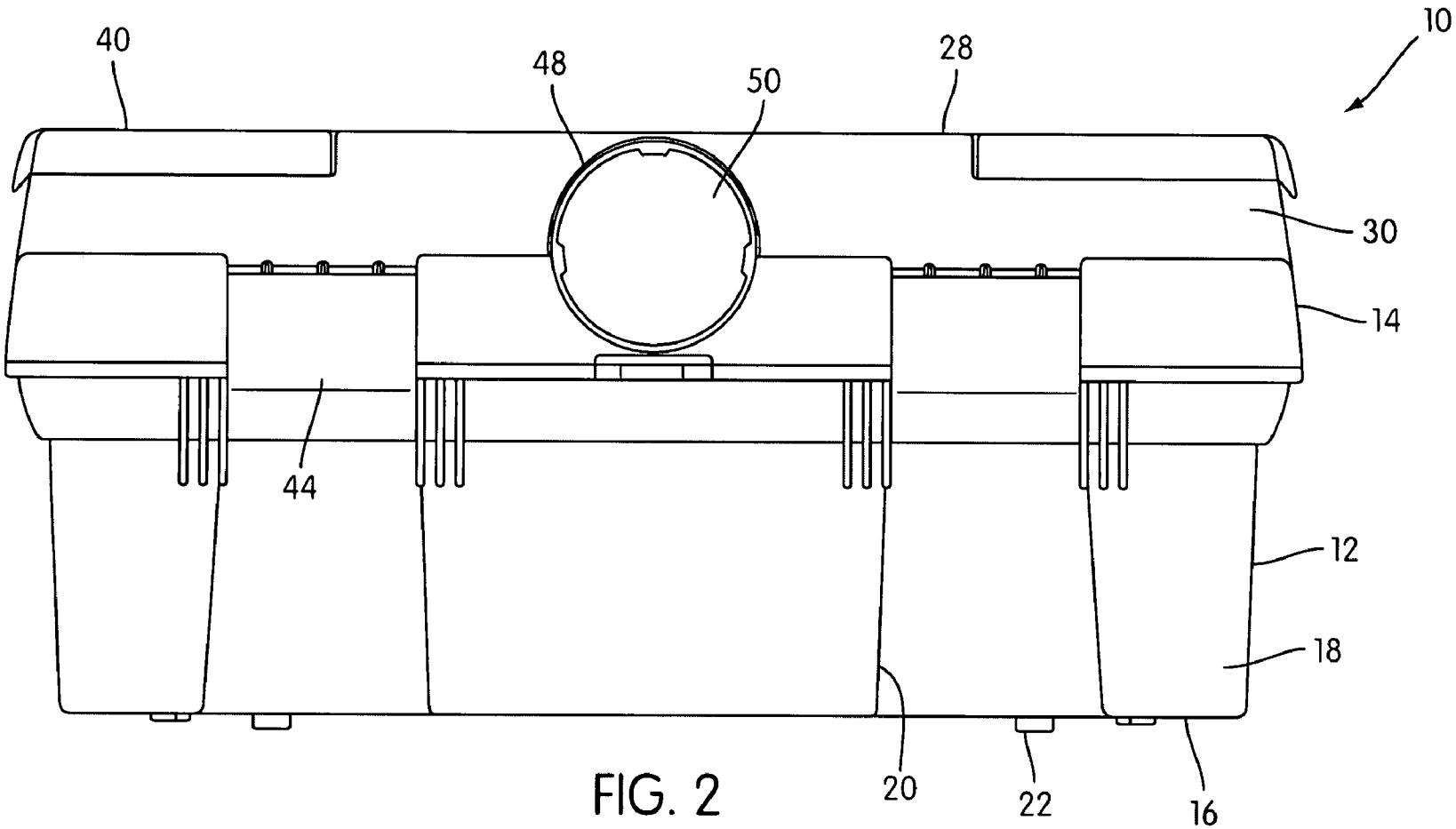
FIG. 2 is a front view of the container of FIG. 1.

Base 12 has a bottom wall 16, seen in FIG. 2, and an exterior side wall 18 formed as four side walls extending from each edge of the bottom wall 16. The side walls 18 and bottom wall 16 can have various depressed or raised portions 20 for strengthening ribs or for aesthetic reasons. The bottom wall 16 may have protrusions 22 to slightly elevate the bottom wall 16 from a support surface, thus protecting the bottom wall 16 and making it easier to lift the container 10. The bottom wall 16 and side walls 18 define an interior storage compartment 24, seen in FIG. 4. The front side wall 18 has a pair of hook portions 26 to latch the cover 14, as described below.

The cover 14 has a top wall 28 and an exterior side wall 30 formed as four side walls extending from each edge of the top wall 28. The top wall 28 and side walls 30 form an internal compartment 32, seen in FIG. 4. Compartment 24 and compartment 32 join to form an interior storage space.

Top wall 28 has a handle 34 pivotally mounted thereon in a handle depression 36. By this configuration, handle 34 can pivot between an upright lifting position and a folded position flush with the top surface of the container. A storage compartment 38 with a cover 40 is optionally provided in the top wall 28 of the cover 14. The compartment cover 40 snaps to the side wall 30 to securely store items. Preferably, the compartment cover 40 is translucent so that objects stored in the compartments 38 can be seen without opening the compartment cover 40. As seen in FIG. 1, a storage compartment 38 is provided on each side of the cover 14. Any configuration of storage compartments 38 may be provided.

Figure 3:
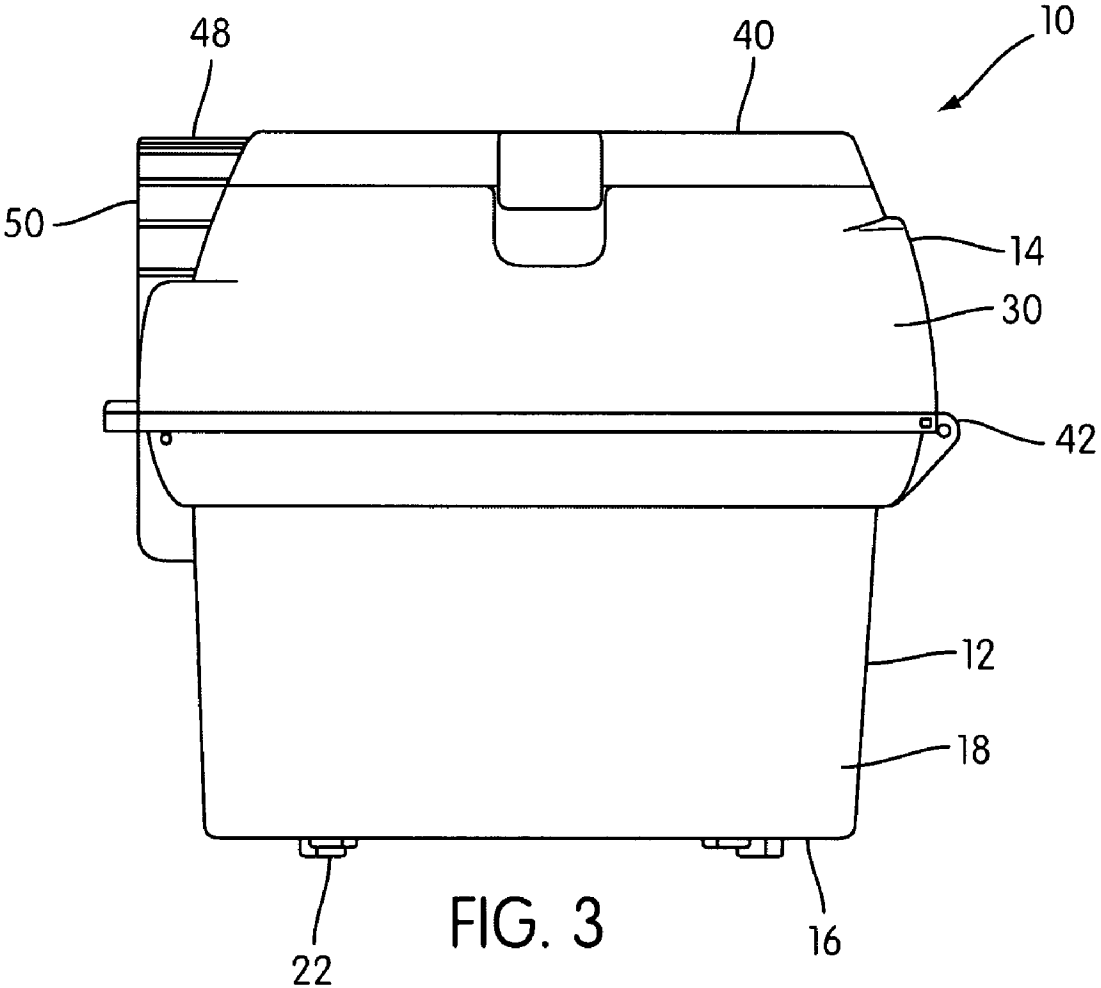
FIG. 3 is a side view of the container of FIG. 1.
Figure 4:
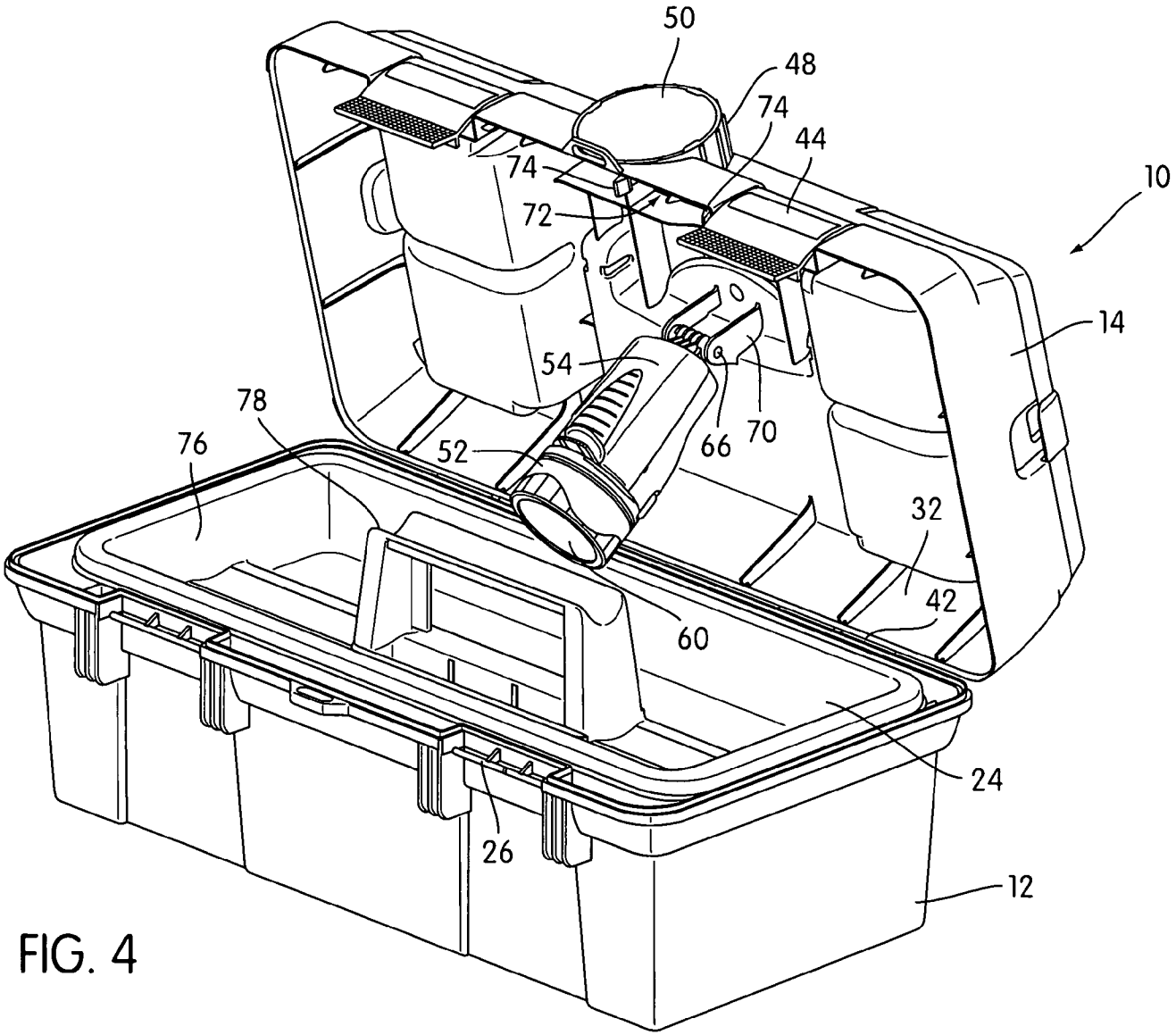
FIG. 4 is a perspective front view of the container of FIG. 1 in an open position.

Cover 14 is coupled to base 12 with a hinge 42, seen in FIGS. 3 and 4. Any type of hinge may be used that allows the cover 14 to open with respect to the base 12. Latches 44 are mounted to cover 14 to selectively secure cover 14 to hooks 26 on base 12. Again, any type of latch may be used. A locking formation 46 may be provided to mount a lock to the container 10 if desired. The locking formation 46 includes a pair of aligned slots formed on the edge of cover 14 and base 12 through which a lock may be inserted.

A generally cylindrical protrusion 48 is formed in the front side wall 30 of cover 14 that has a light permeable lens 50. As seen in FIG. 3, preferably the protrusion 48 is flush with the outer surface of the tool box 10. However, the size of the protrusion 48 and the extent to which it extends from the cover 14 can vary based on design choice. It is even possible to mount the lens 50 flush with the side wall 30 of cover 14 without a protrusion 48. The lens 50 is preferably clear, transparent plastic, but could also be a colored lens if desired. Any material may be used that permits light transmission.

Figure 5:
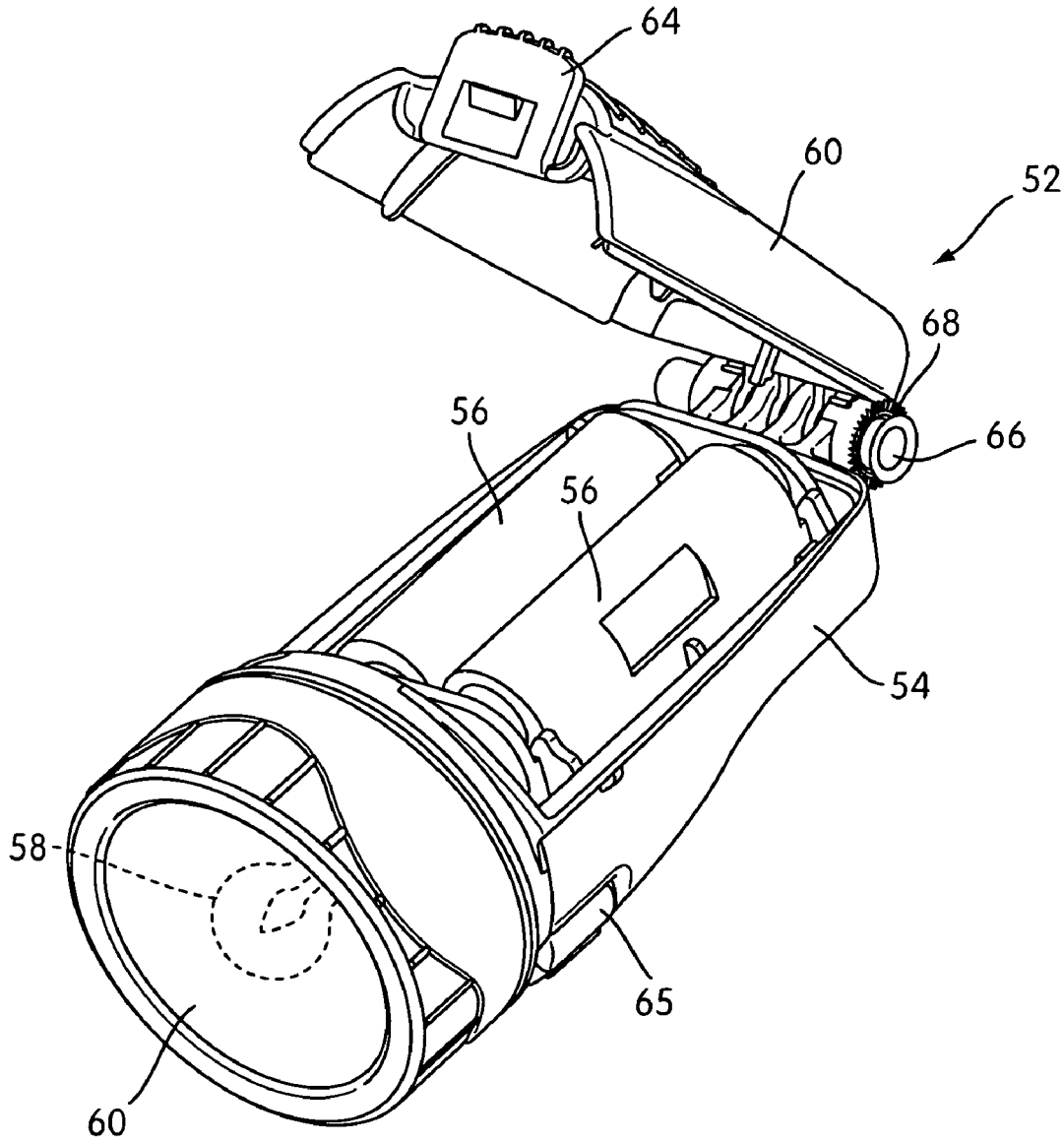
FIG. 5 is an enlarged view of the light in accordance with an embodiment of the invention.

As seen in FIG. 4, the protrusion 48 is designed to mate with a light 52 that is retained within the cover 14 inside the box 10. The light 52 is seen in detail in FIG. 5. Preferably, the light 52 includes a body 54 with a power source 56, in this case batteries, contained in a compartment therein and an illumination device 58, such as an incandescent bulb. The body 54 is preferably made of lightweight material, such as plastic. Of course, any type of power source may be used, including conventional alkaline batteries or rechargeable batteries.

The illumination device 58 may be any know device that generates light, including various known types of light bulbs. The illumination device 58 is preferably covered with a lens 60. The compartment for the power source is covered with a pivotal compartment cover 62 that may be opened with a releasable latch 64 for easy access to the power source. By this, for example, batteries may be quickly and easily changed when necessary. An ON/OFF switch 65 is provided on the body 54 to connect the power source 56 to the illumination device 58. The back end of the body 54 has a pivot rod 66 with a serrated gear 68, the purpose of which is described below. The compartment cover 62 is carried on the pivot rod 66 for easy pivoting with respect to the body 54.

Referring back to FIG. 4, the light 52 is mounted in the cover 14 on a pair of flanges 70 that retain pivot rod 66 and create an articulated support. At least one of the flanges 70 also has a serrated gear similar to gear 68 designed to engage gear 68 when the body 54 of the light 52 is rotated. By this engagement, each serration defines a discrete position at which the light 52 may be disposed. This enables the light 52 to be securely positioned at any desired angle to illuminate the interior storage compartment 24 or the environment surrounding the tool box 10.

The internal compartment 32 of the cover 14 also has a locking formation 72 in the form of a pair of hooked fingers 74 that protrude outwardly from the cover 14. The hooked fingers 74 are positioned to surround and engage the body 54 of the light 52 when the light 52 is pivoted upwardly into the internal compartment 32. The hooked fingers 74 lock the light 52 in place into alignment with the lens 50 so that the illumination device 58 is directed outward through the lens 50. In this position, the cover 14 can be closed while the light 52 is turned ON to illuminate the environment around the tool box 10. The light 52 can also remain ON when the tool box 10 is transported.

A removable tray 76, for storing small items for example, may be mounted in the internal compartment 24. Tray 76 has a handle 78 and can be lifted from the box 10 to hold and transport tools or other items. Base 12 has an inner flange that supports the lip of the tray 76. When the cover 14 is closed, tray 76 does not interfere with light 52. It is also possible to form internal non-removable compartments in the internal compartment 24.

It can be seen by above description that tool box 10 includes a light 52 that can used when the cover 14 is open or closed. The position of light 52 can also be selectively adjusted to shine out of the box 10 or within the box 10 at various locations in the compartment 24. This allows a user to use the box 10 to illuminate an object that the user is working on, such as an automobile tire, and to illuminate the interior of the box 10 to locate a tool when insufficient external light is available, such as at a roadside.

Figure 6:
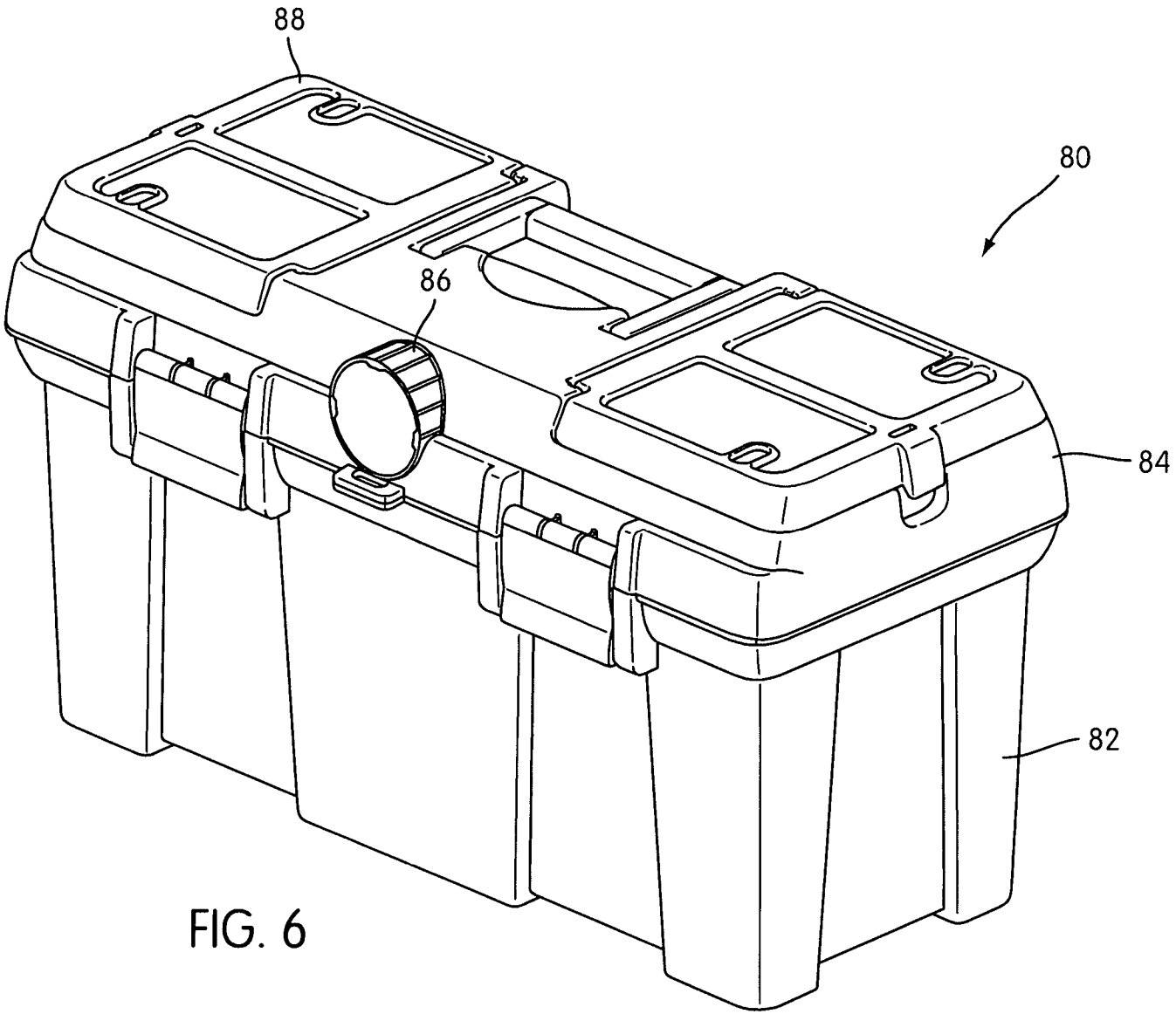
FIG. 6 is a perspective view of a modified container in accordance with the invention.

FIG. 6 shows a modified storage container 80 having a larger base 82 and a cover 84 with a light opening 86. Cover 84 has partitioned compartments 88 on each side that have compartment covers. As can be appreciated from the various compartment arrangements, any shape or number of compartments can be provided if desired. In this case, base 82 is significantly larger and may constitute a workbench type of storage container. A light within the container 80 works in the same manner as box 10.

Various modifications and changes can be made to the invention and remain within the scope of the invention. It is possible to mount the light in the base, rather than the cover. It is also possible to modify the position of the light transmitting opening to be in the base or in another position on the cover.

It is also contemplated that the light can be removable, in which case the body of the light can be formed as a sleeve that the light is removably retained in so that a user can remove the light and use it as a hand held flashlight. Alternatively, the body of the light can be released from the hinge, such as by a snap fit, for hand held use. These and other modifications are within the scope of the invention as defined by the appended claims.

What is claimed is:

1. A tool box comprising:

a base having a bottom and side walls;

a cover having a top and side walls, the cover being movably mounted to the base to move between a closed position and an open position, wherein the base and the cover define a storage compartment therein and one of the side walls of the cover has a light permeable member;

a carrying handle mounted on the cover; and a light movably mounted in the storage compartment and inclusiding a power source and an illumination device, wherein the light is movable into a plurality of positions relative to said compartment, including a position wherein the illumination device is oriented toward the light permeable member.

2. The tool box of claim 1, wherein the light includes a battery compartment and a battery compartment cover.

3. The tool box of claim 1, wherein the base and cover are made of plastic.

4. The tool box of claim 1, further comprising a latch mounted between the cover and the base for releasably securing the cover to the base.

5. The tool box of claim 1, further comprising a handle mounted to the cover.

6. The tool box of claim 1, wherein the cover has at least one compartment with a cover that is accessible from the exterior of the tool box.

7. A tool box comprising:

a base having a bottom and side walls;

a cover having a top and side walls, the cover being movably mounted to the base to move between a closed position and an open position, wherein the base and the cover define a storage compartment therein and one of the side walls has a light permeable member;

a carrying handle mounted on the cover; and a light including a power source and an illumination device, wherein the light is movably mounted in the cover on an articulated support such that the light is movable between a first position directed to the light permeable member and a second position directed within the base.

8. The tool box of claim 7, wherein the articulated support is a pivot.

9. The tool box of claim 7, wherein the articulated support includes a plurality of discrete support points that allow selective positioning of the light at a plurality of angles with respect to the cover.

10. The tool box of claim 7, wherein the cover has a locking formation disposed adjacent to the articulated support that releasably receives the light to lock it in the first position.

11. A container comprising:

a bottom wall;

a top wall;

side walls extending between the bottom wall and the top wall to form an interior storage compartment, wherein at least one of the outer side walls has a light transmitting region; and a light mounted within the interior storage compartment and including a power source and an illumination device, the illumination device being movable between a position in which the illumination device directs light through the light transmitting region and a position in which the illumination device directs light into the interior storage compartment.

12. The container of claim 11, wherein the light transmitting opening is sealed by a light permeable member.

13. The container of claim 11, wherein the top compartment forms a cover, and the bottom compartment forms a base.

14. The container of claim 13, wherein the cover has an articulated support to which the light is mounted for movement.

15. The container of claim 11, further comprising a removable storage tray.

16. The container of claim 11, wherein the top compartment includes storage compartments with covers.

17. The container of claim 11, further comprising a handle mounted to the top compartment.

18. The container of claim 11, wherein a latch removably connects the top compartment to the bottom compartment.

19. A container comprising:

a bottom wall;

a top wall;

outer side walls extending between the bottom wall and the top wall to form an interior storage compartment, wherein the outer side walls have a light transmitting region; and a light mounted to one of the walls within the interior storage compartment, said light including a power source and an illumination device, further comprising an articulated support coupled to the light such that the light may be moved from a first position directed at the light transmitting region to a second position directed within the interior storage compartment.

20. The container of claim 19, wherein the articulated support is mounted to the top wall.

21. A container comprising:

a base having a bottom and lower side walls defining a container;

a cover having a top and upper side walls, said cover being pivotable about a horizontal axis with respect to the base;

a light transmitting opening formed in at least one of the upper side walls;

a light pivotally attached to the cover and adapted to be movable between a first position directed toward the light transmitting opening and a second position directed away from the light transmitting opening and toward the base.

22. A container with an open state and a closed state comprising:

an interior storage compartment;

a light mounted within the interior storage compartment;

a support for the light adapted to position the light in a first position, in which illumination from the light is directed externally from the container when the container is in the closed state, and in a second position, in which illumination from the light can be directed internally into the container when the container is in the open state.

23. The container of claim 21, further including a lock for locking the cover to the base.

* * * * *